US011085229B2

(12) United States Patent
Mitchell et al.

(10) Patent No.: US 11,085,229 B2
(45) **Date of Patent: *Aug. 10, 2021**

(54) THRESHOLD AND THRESHOLD CAP ASSEMBLY

(71) Applicant: Endura Products, Inc., Colfax, NC (US)

(72) Inventors: Michael Mitchell, Winston-Salem, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/519,086

(22) Filed: Jul. 23, 2019

(65) Prior Publication Data

US 2020/0024889 A1 Jan. 23, 2020

Related U.S. Application Data

(60) Provisional application No. 62/701,949, filed on Jul. 23, 2018.

(51) Int. Cl.
*E06B 1/70* (2006.01)
*E06B 7/18* (2006.01)

(52) U.S. Cl.
CPC . *E06B 1/70* (2013.01); *E06B 7/18* (2013.01)

(58) Field of Classification Search
CPC . E06B 1/70; E06B 7/18; E06B 7/2316; E06B 7/2312
USPC ..... 49/468, 469, 467
See application file for complete search history.

(56) References Cited

U.S. PATENT DOCUMENTS

| | | | |
|---|---|---|---|
| 56,046 | A | 7/1866 | Hawkins |
| 126,014 | A | 4/1872 | Brown |
| 220,460 | A | 10/1879 | York |
| 313,742 | A | 3/1885 | Kintner |
| 394,864 | A | 12/1888 | Lathrop |

(Continued)

FOREIGN PATENT DOCUMENTS

| | | |
|---|---|---|
| CA | 139250 | 1/2012 |
| CA | 2771705 | 8/2014 |

(Continued)

OTHER PUBLICATIONS

US 5,542,391 A, 06/1996, Joffe et al. (withdrawn)

(Continued)

*Primary Examiner* — Jerry E Redman
(74) *Attorney, Agent, or Firm* — Womble Bond Dickinson (US) LLP

(57) ABSTRACT

An assembly that is configured to form a seal with a bottom of a closed door panel includes a holder, a threshold cap, and a biasing member. The holder defines a pivot axis and is configured to releasably couple to a substrate of a threshold. The threshold cap includes a sealing wall and a joint portion. The sealing wall is configured to form a seal with the bottom of the closed door. The joint portion is engaged with the holder to pivotally support the threshold cap about the pivot axis. The biasing member biases the sealing wall away from the holder towards a raised position.

22 Claims, 9 Drawing Sheets

(56) References Cited

U.S. PATENT DOCUMENTS 435,658 A * 9/1890 Brennaman ..... E06B 7/2316 49/469
500,885 A 7/1893 Green et al.
582,451 A 5/1897 Brannon
600,301 A 3/1898 Barger
618,013 A 1/1899 Roeder
628,278 A 7/1899 Mitsch
704,395 A 7/1902 Sowden
1,210,535 A 1/1917 Riley
1,468,958 A 9/1923 Champion
1,595,827 A 8/1926 Frisque
1,795,853 A 3/1931 Glass
1,883,609 A 10/1932 Dennis
1,993,506 A 3/1935 Fauner
2,108,137 A 2/1938 Oftedal et al.
2,129,381 A 9/1938 Oftedal et al.
2,202,482 A 5/1940 Dahl
2,293,292 A * 8/1942 Goellner ..... E06B 7/232 49/489.1
2,555,244 A * 5/1951 Pietrushak ..... E06B 7/18 49/480.1
2,579,875 A 12/1951 Stanko
2,630,891 A 3/1953 Zitomer
2,663,056 A 12/1953 Hardgrave
2,696,029 A 12/1954 Neff
2,728,118 A 12/1955 Gossen
2,818,614 A 1/1958 Lapka, Jr.
2,949,651 A 8/1960 Hill
3,083,420 A 4/1963 Tinflow
3,114,180 A 12/1963 Riedl
3,250,040 A 5/1966 Squires
3,273,287 A 9/1966 Pease, Jr.
3,374,579 A 3/1968 Neff
3,378,958 A 4/1968 Parks
3,402,512 A 9/1968 Peterson
3,432,966 A 3/1969 Bordner
3,448,543 A 6/1969 Mutler
3,475,866 A 11/1969 Johansen
3,521,404 A 7/1970 Hager
3,690,037 A 9/1972 Kempel
3,762,100 A 10/1973 Kempel
3,854,246 A 12/1974 McAllister
3,900,967 A 8/1975 Bursk et al.
3,962,828 A 6/1976 McAllister
3,967,412 A 7/1976 Governale
4,034,511 A 7/1977 Bursk
4,055,917 A 11/1977 Coller
4,073,093 A 2/1978 Ookawa
4,074,464 A 2/1978 McCay
4,079,550 A 3/1978 Bursk et al.
4,104,830 A 8/1978 Eagle
4,114,319 A 9/1978 Governale
4,146,995 A 4/1979 Britt
4,156,325 A 5/1979 McMullen et al.
4,185,417 A 1/1980 McKann
4,213,275 A 7/1980 Oehmig
4,224,766 A 9/1980 Procton
4,287,684 A 9/1981 McKann
4,310,991 A 1/1982 Seely, Jr.
4,352,258 A 10/1982 Bursk et al.
4,387,535 A 6/1983 Corbo
D270,185 S 8/1983 Wooten
4,411,104 A 10/1983 St. Aubin
4,447,987 A 5/1984 Lesosky
4,447,989 A 5/1984 Malland et al.
4,513,536 A 4/1985 Giguere
D279,409 S 6/1985 Allen
4,525,953 A 7/1985 Stutzman
4,538,380 A 9/1985 Colliander
4,625,457 A 12/1986 Avery
4,628,639 A 12/1986 Lownsdale
4,686,793 A 8/1987 Mills
4,716,683 A 1/1988 Minter
4,831,779 A 5/1989 Kehrli et al.
5,010,690 A 4/1991 Geoffrey
5,012,614 A 5/1991 Shea
5,018,307 A 5/1991 Burrous et al.
5,056,263 A 10/1991 Bies
5,067,279 A 11/1991 Hagemeyer
5,136,814 A 8/1992 Headrick
5,150,544 A 9/1992 Burnett
5,174,065 A 12/1992 Schlicht
5,179,804 A 1/1993 Young
5,214,880 A 6/1993 Woodruff
5,230,181 A 7/1993 Geoffrey
5,283,977 A 2/1994 Smith
D354,572 S 1/1995 Headrick
5,426,894 A 6/1995 Headrick
5,475,946 A 12/1995 Howe
5,517,788 A 5/1996 McGough et al.
5,588,266 A 12/1996 Headrick
5,592,782 A 1/1997 Scott
5,611,173 A 3/1997 Headrick et al.
5,638,641 A 6/1997 Joffe
5,675,935 A 10/1997 Lin
5,706,607 A 1/1998 Frey
5,857,291 A 1/1999 Headrick
5,887,392 A 3/1999 Martin
5,943,824 A 8/1999 Procton et al.
5,943,825 A 8/1999 Procton et al.
6,006,375 A 12/1999 Carr
6,052,949 A 4/2000 Procton et al.
6,061,967 A 5/2000 Judda
6,125,584 A 10/2000 Sanders
6,138,413 A 10/2000 Fehr
6,216,395 B1 4/2001 Kelly
6,289,635 B1 9/2001 Procton et al.
6,345,477 B1 2/2002 Kepler
6,367,201 B1 4/2002 Massey
6,371,188 B1 4/2002 Baczuk et al.
6,374,545 B1 4/2002 Baczuk
6,412,227 B1 7/2002 De Zen
6,484,446 B2 11/2002 Young
D488,243 S 4/2004 Babka et al.
6,763,639 B2 7/2004 Bennett et al.
6,789,358 B2 9/2004 Procton et al.
6,829,864 B2 12/2004 Mitchell et al.
7,114,293 B2 10/2006 Purlee
7,140,154 B2 11/2006 Governale
D549,850 S 8/2007 Perlman
7,263,808 B2 9/2007 Massey et al.
7,266,929 B1 9/2007 Allred et al.
7,350,336 B2 4/2008 Bennett
7,389,611 B2 6/2008 Palenske
7,472,516 B2 1/2009 Pepper et al.
7,600,346 B2 10/2009 Meeks
7,644,539 B2 1/2010 Baxter
7,669,369 B2 3/2010 Henry et al.
7,694,471 B2 4/2010 Meeks
7,788,863 B2 9/2010 Pepper
D627,488 S 11/2010 Abdollahzadeh et al.
7,878,559 B2 2/2011 Meeks
D638,142 S 5/2011 Van Camp et al.
D638,958 S * 5/2011 Van Camp ..... D25/119
8,074,699 B2 12/2011 Jones et al.
8,371,069 B2 2/2013 O'Sullivan
8,375,659 B2 2/2013 Bogenhagen
8,413,383 B2 4/2013 Van Camp
8,522,483 B2 9/2013 Van Camp et al.
D696,794 S 12/2013 Mossman
D696,795 S 12/2013 Mossman
8,726,575 B1 5/2014 Vulpitta
8,813,427 B2 * 8/2014 Meeks ..... E06B 7/26 49/471
D713,976 S 9/2014 Van Camp
8,875,443 B2 11/2014 Siegel
D722,387 S * 2/2015 Van Camp ..... D25/48.2
D722,388 S 2/2015 Van Camp
8,991,100 B2 3/2015 Van Camp et al.
8,991,101 B2 3/2015 Van Camp et al.
D733,927 S 7/2015 Van Camp
D748,284 S 1/2016 Boer
9,316,041 B2 4/2016 Olson
9,371,682 B2 6/2016 Van Camp et al.

(56) References Cited

U.S. PATENT DOCUMENTS

| | | | | |
|---|---|---|---|---|
| 9,487,992 | B2 * | 11/2016 | Meeks | E06B 1/70 |
| 9,528,314 | B2 * | 12/2016 | Mitchell | E06B 7/18 |
| 9,562,387 | B2 | 2/2017 | Meeks | |
| D797,309 | S | 9/2017 | Jaskiewicz et al. | |
| 9,874,054 | B2 * | 1/2018 | Mitchell | E06B 7/18 |
| 10,066,433 | B2 * | 9/2018 | Van Camp | E06B 1/70 |
| 10,077,593 | B2 * | 9/2018 | Meeks | E06B 7/2316 |
| 10,370,891 | B2 * | 8/2019 | Farahmandpour | E06B 1/70 |
| 10,407,975 | B2 | 9/2019 | Van Camp et al. | |
| 2002/0129557 | A1 | 9/2002 | Young | |
| 2002/0194787 | A1 | 12/2002 | Bennett | |
| 2003/0005644 | A1 | 1/2003 | Reithmeyer et al. | |
| 2004/0139667 | A1 | 7/2004 | Massey et al. | |
| 2004/0200153 | A1 | 10/2004 | Khanlarian | |
| 2005/0198911 | A1 | 9/2005 | Baczuk | |
| 2005/0210754 | A1 | 9/2005 | Ferrell | |
| 2005/0223647 | A1 | 10/2005 | Stutzman | |
| 2006/0053695 | A1 | 3/2006 | Palenske | |
| 2006/0174545 | A1 | 8/2006 | Young | |
| 2006/0283087 | A1 | 12/2006 | Baxter | |
| 2006/0283090 | A1 * | 12/2006 | Moody | E06B 1/70 49/467 |
| 2007/0227076 | A1 | 10/2007 | Braun | |
| 2007/0261312 | A1 | 11/2007 | Kuppler | |
| 2008/0110100 | A1 | 5/2008 | Heppner | |
| 2008/0229669 | A1 | 9/2008 | Abdollahzadeh et al. | |
| 2009/0199486 | A1 | 8/2009 | Wemiund et al. | |
| 2010/0107503 | A1 | 5/2010 | Chapman | |
| 2010/0192469 | A1 | 8/2010 | McDaniel | |
| 2010/0242393 | A1 | 9/2010 | Kornfalt | |
| 2010/0257789 | A1 | 10/2010 | Meeks | |
| 2012/0079771 | A1 | 4/2012 | Meulemans | |
| 2012/0324817 | A1 | 12/2012 | Stanchfield | |
| 2013/0047518 | A1 * | 2/2013 | Van Camp | E06B 7/2316 49/468 |
| 2013/0199100 | A1 * | 8/2013 | Van Camp | E06B 1/70 49/468 |
| 2013/0276376 | A1 | 10/2013 | Gilbert | |
| 2016/0014593 | A1 | 5/2016 | Meeks | |
| 2016/0145931 | A1 * | 5/2016 | Meeks | E06B 1/70 49/468 |
| 2016/0340968 | A1 | 11/2016 | Mitchell et al. | |
| 2017/0058592 | A1 † | 3/2017 | Meeks | |
| 2019/0330916 | A1 * | 10/2019 | Mitchell | E06B 7/2312 |

FOREIGN PATENT DOCUMENTS

| | | | |
|---|---|---|---|
| CA | 2842214 | | 9/2014 |
| CA | 153751 | | 9/2015 |
| CA | 153953 | | 9/2015 |
| CA | 166338 | | 9/2016 |
| CA | 166339 | | 9/2016 |
| CA | 170072 | | 5/2017 |
| CA | 2928089 | | 7/2017 |
| CA | 177370 | | 10/2018 |
| CN | 3480288 | | 10/2005 |
| DE | 2135919 | A1 | 7/1971 |
| DE | 19932332 | | 2/2001 |
| DE | 19932332 | | 10/2003 |
| DE | 19932332 | C2 | 10/2003 |
| EP | 327840 | | 8/1989 |
| FR | 945217 | A | 4/1947 |
| GB | 189809888 | A | 3/1899 |
| GB | 411361 | | 6/1934 |
| GB | 2063341 | | 6/1981 |
| JP | 1986085690 | | 6/1986 |
| JP | 06026278 | | 2/1994 |
| JP | 10037626 | | 2/1998 |
| JP | 10102937 | | 4/1998 |
| JP | 1998110579 | | 4/1998 |
| JP | 2003013672 | | 1/2003 |
| JP | 2005023628 | | 1/2005 |
| KR | 10094929 | B1 | 6/2006 |

OTHER PUBLICATIONS

American Architectural Manufacturers Association, AAMA AG-11 AAMA Glossary, believed to be available as of 2011, pp. 50 ("threshold"), 54 ("weatherstrip"), (http://www.aamanet.org/general/1/241/skylight-glossary-of-terms, accessed on Mar. 20, 2013), 58 pgs.

Canadian Office Action for App. No. 3003054, dated Jun. 6, 2019, 4 pgs.

Combo Aluminum Products, 50th Anniversary Catalog, believed to be available 2008, cover page, pp. 1, 28 (hardwood cap), 31 (composite cap), 45 (foam weather-strip), (http://www.comboaluminum.com/Catalog/Combo_Aluminum_Catalog.pdf, accessed Mar. 20, 2013), 59 pgs.

Door Sill Cap drawing, known as of Apr. 19, 2010, 1 pg.

Endura Products, Glossary, 7 pages ("Cap/Riser", "Sill", "Weatherstrip"), available as of Aug. 22, 2011 (http://www.enduraproducts.com/technical-info/glossary.aspx, accessed Mar. 20, 2013).

GPI Millworks, Outswing Sill, https://gpimillworks.com/pultruded-fiberglass-sills/, known at least as early as Apr. 24, 2018, 1 pg.

Official Action of U.S. Appl. No. 13/215,905, dated Feb. 15, 2013, 17 pgs.

Official Action of U.S. Appl. No. 13/215,905, dated Nov. 14, 2012, 16 pgs.

Profile Selection Guide Building Products Division, Schlegel Systems, Inc., believed to be available as of Jun. 2008, page entitled T-Slot Aptus® TPE Weatherseals, 3 pgs.

Therma-tru Doors, Composite Outswing Sill, 2016 Full-Line Catalog, known at least as early as Apr. 24, 2018, 1 pg.

ThermaTru Doors Product Manual, Comp 13, Comp11, Jan. 2011 (online). Designs shown therein known at least as early as Aug. 24, 2010. Retrieved on Mar. 3, 2011: <URL: www.thermatru.com/customer-support/technical-manuals/ArchComp/Comp-12-14.pdf>; <URL: http://www.thermatru.com/customer-support/technical-manuals/manuals/ArchComp/Comp11.pdf>, 6 pgs.

ThermaTru Doors Product Manual, Comp 13, Kerf Door Bottom, Jun. 2005, 2 pgs.

ThermaTru Doors, Sills Product Manual, Comp 11, Self-Adjusting Thermal Break Sill, Jun. 2005, 4 pgs.

Threshold Sill, Imperial, known as of Mar. 19, 2007.

Threshold Sill, Stanley, known as of Mar. 19, 2007.

Window & Door Manufacturers Association, The Door Glossary, AAMA/WDMA/CSA 101/I.S.2/A440-11, NAFS—North American Fenestration Standard/Specification for Windows, Doors, and Skylights, believed to be available 2011, (https://www.wdma.com/TechnicalCenter/TheDoorGlossary/tabid/84/Default.aspx, accessed on Mar. 20, 2013), 9 pgs.

Window & Door Manufacturers Association, The Window Glossary, AAMA/WDMA/CSA 101/I.S.2/ A440-11, NAFS—North American Fenestration Standard/Specification for Windows, Doors, and Skylights, believed to be available 2011, (https://www.wdma.com/TechnicalCenter/TheWindowGlossary/tabid/109/Default.aspx, accessed on Mar. 18, 2013), 11 pgs.

Worldwide Door Components, Outswing Sill, http://www.wwph.com.cn/products.asp?class_pd=2&id=2&class_pd2=2&class_pd3=2&fi=THRESHOLDS, known at least as early as Apr. 24, 2018, 1 pg.

* cited by examiner
† cited by third party

THRESHOLD AND THRESHOLD CAP ASSEMBLY

CROSS-REFERENCE TO RELATED APPLICATION

This application claims the benefit of, and priority to, U.S. Provisional Patent Application No. 62/701,949, filed Jul. 23, 2018, the entire contents of which are hereby incorporated by reference.

FIELD OF DISCLOSURE

The present disclosure relates generally to thresholds for residential and commercial buildings. Many embodiments of the present disclosure relate to thresholds having threshold cap assemblies that are self-adjusting.

BACKGROUND

Entryways provide the necessary ingress and egress from residential and commercial buildings. Entryway systems used in building construction generally include a pair of vertically extending door jambs and a head jamb that frame the entryway and receive at least one hinged door panel. An elongated threshold is generally attached at its ends to the bottoms of the door jambs, and spans the bottom of the entryway. Many modern thresholds include a threshold cap positioned to underlie a closed door mounted in the entryway. In some instances, the threshold cap is manually adjustable in a vertical direction to engage and form a seal along the bottom of the door panel or a flexible sweep attached thereto. Manually adjustable threshold caps remain stationary as the door opens and closes.

Manufacturers of entryway systems and components thereof, continue to seek designs that provide a durable, weather-tight seal, including along the bottom of a closed door panel. The goal of these components is to function as a system to prevent the unwanted infiltration of air or water through the entryway when the door panel is closed. One known problem is that houses can settle after construction, thus compromising the weather sealing of the door panel due to movement of the mating components from their initial installed position. In the past, a homeowner could vertically adjust the threshold cap manually in order to correct this issue. Experience has shown, however, that homeowners rarely use the adjustment features of the prior art. Accordingly, a need continues to exist for a threshold that improves the ability to seal out air and water along the bottom of the door panel even as the fit between a door panel and the threshold changes.

SUMMARY

In an embodiment of the present disclosure, an assembly is disclosed for forming a seal along the bottom of a door panel. The assembly comprises a holder creating a pivot axis and a threshold cap configured to underlay the door panel when the door panel is in a closed position. The threshold cap comprises a sealing wall configured to form a seal with the door panel or a door sweep thereof. The threshold cap also includes a joint portion configured to engage with the holder such that the sealing wall is capable of pivoting about the pivot axis. The assembly also includes a biasing member configured to bias the sealing wall upward.

In another embodiment of the present disclosure, the assembly is used in a threshold that includes a nosing and a dam. The nosing is spaced apart from the dam. The nosing faces an interior of the threshold and the dam faces an exterior of the threshold. The assembly is positioned such that the pivot axis is positioned between the nosing and the dam along an interior-exterior direction of the threshold, the pivot axis being closer to the nosing than to the dam.

In another embodiment of the present disclosure, an assembly is configured to form a seal with a bottom of a closed door panel includes a holder, a threshold cap, and a biasing member. The holder defines a pivot axis and is configured to releasably couple to a substrate of a threshold. The threshold cap includes a sealing wall and a joint portion. The sealing wall is configured to form a seal with the bottom of the closed door. The joint portion is engaged with the holder to pivotally support the threshold cap about the pivot axis. The biasing member biases the sealing wall away from the holder towards a raised position.

In embodiments, the holder includes a base and a projection that extends away from the base. The projection defines a socket about the pivot axis. The joint portion of the threshold cap is received within the socket.

In some embodiments, the holder includes a base and a portion that extends away from the base. The projection may include a bulb-shaped tip about the pivot axis. The joint portion may define a socket that receives the tip. The socket may be configured to snap onto the tip of the holder or the socket may be configured to slide onto the tip of the holder.

In certain embodiments, one end of the biasing member is supported by the holder. The holder may include a post that extends towards the threshold cap. The one end of the biasing member may be disposed about the post. The holder may define a kerf with the one end of the biasing member received within the kerf. The biasing member may be a coil spring or a leaf spring.

In particular embodiment, the sealing wall has an interior end and an exterior end opposite the interior end. The exterior end may be configured to move a greater magnitude as the threshold cap pivots about the pivot axis compared to a magnitude of movement of the interior end.

In another embodiment of the present disclosure, a threshold includes a nosing, a dam, and an assembly that is configured to form a seal with a bottom of a closed door panel. The nosing faces an interior of the threshold and the dam facing an exterior of the threshold. The dam spaced apart from the nosing to define a channel therebetween. The threshold cap of the assembly overlies the channel.

In embodiments, the assembly is oriented with the pivot axis positioned between the nosing and the dam along an interior-exterior direction of the threshold. The pivot axis may be closer to the nosing than to the dam. The holder may be positioned entirely within the channel.

In some embodiments, the threshold includes a nosing cover that is disposed over the nosing and extends into the channel. The holder may be integrally formed with the nosing cover and extend within the channel from the nosing towards the dam.

In certain embodiments, the threshold includes a substrate that defines a floor of the channel. One end of the biasing member may be supported by the floor of the channel. The substrate may include a post that extends from the floor towards the threshold cap. The one end of the biasing member may be disposed about the post. The floor may define a kerf. The one end of the biasing member may be received within the kerf.

In particular embodiments, the holder may include a base and the floor of the substrate defines a kerf. The base of the holder may be engaged with the kerf to releasably couple the holder within the channel. The substrate may include a pair of fingers that extend into the channel. The pair of fingers may be engaged with the holder to releasably couple the holder within the channel. The threshold cap may include an interior end and an exterior end with the interior end configured to seal an interior side of the channel.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product, or component aspects or embodiments and vice versa.

Figure 1:
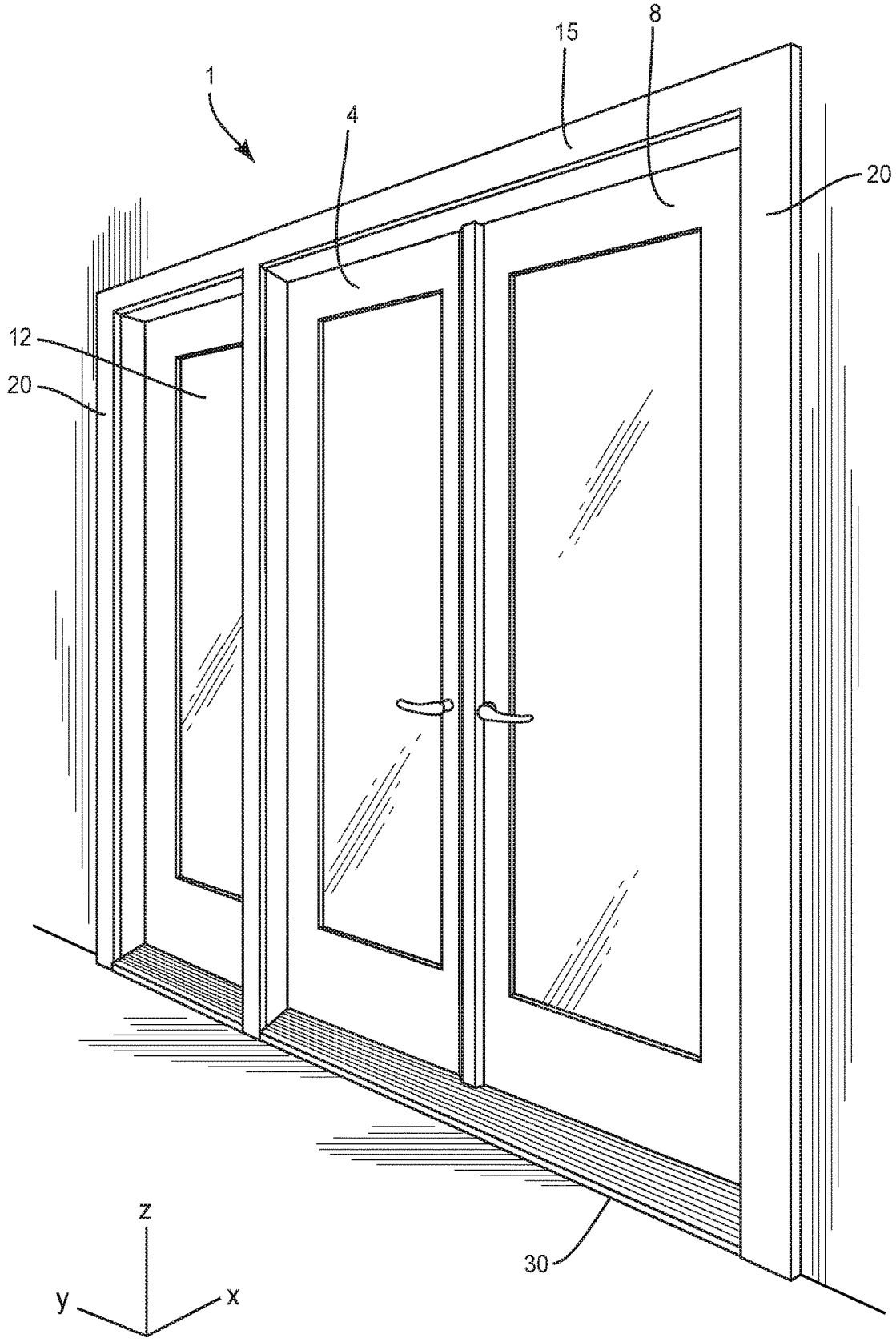
FIG. 1 is a schematic view of an entryway that may benefit from the thresholds disclosed herein.

FIG. 1 illustrates an entryway 1 that may incorporate one or more components of the present disclosure. The illustrated entryway 1 includes a French door arrangement with a first door panel 4 and a second door panel 8. The entryway 1 is also shown with a sidelight 12. The top of the entryway 1 includes a header 15, and the edges of the entryway 1 can be defined by side jambs 20. A threshold 30 extends along the bottom of the entryway 1. The configuration of the entryway 1 shown in FIG. 1 is provided as an example only and is not intended to limit the scope of this disclosure. Particularly, the entryway 1 may include only a single door panel, a double door entryway, or even a larger plurality of door panels and windows.

The illustrated embodiments of the present disclosure apply primarily to in-swing type entryways where the door panel is within the interior of the building when the door panel is open. However, unless expressly noted, the type of entryway, e.g., in-swing or out-swing, should not affect the scope of this disclosure. As used herein, the terms interior, inner, inward, etc., and the terms exterior, outer, outward, etc., are used to describe relative positions of features with respect to the entryway 1, the threshold 30, and the inside and outside of a corresponding building when the threshold is in-use. Notably, FIG. 1 illustrates the exterior of the entryway 1. Also, as used herein, the width direction extends from an interior to an exterior of a building, or vice versa. The width direction is defined along the X-axis shown in FIG. 1. The length direction extends relatively between the side jambs 20 of the entryway 1 parallel with the Y-axis shown in FIG. 1. The height direction extends substantially along the vertical direction and parallel with the major axis of the side jambs 20, parallel to the Z-axis in FIG. 1. As used herein, the terms "rigid" and "resilient" are used with respect to one another. Therefore, when an element made from rigid material interacts with an element made from a resilient material, the resilient element will deform more readily than the rigid element. As used herein, rigid materials are intended to maintain their shape and resilient materials are intended to be pliable to alter their shape when faced with anticipated external forces.

Figure 2:
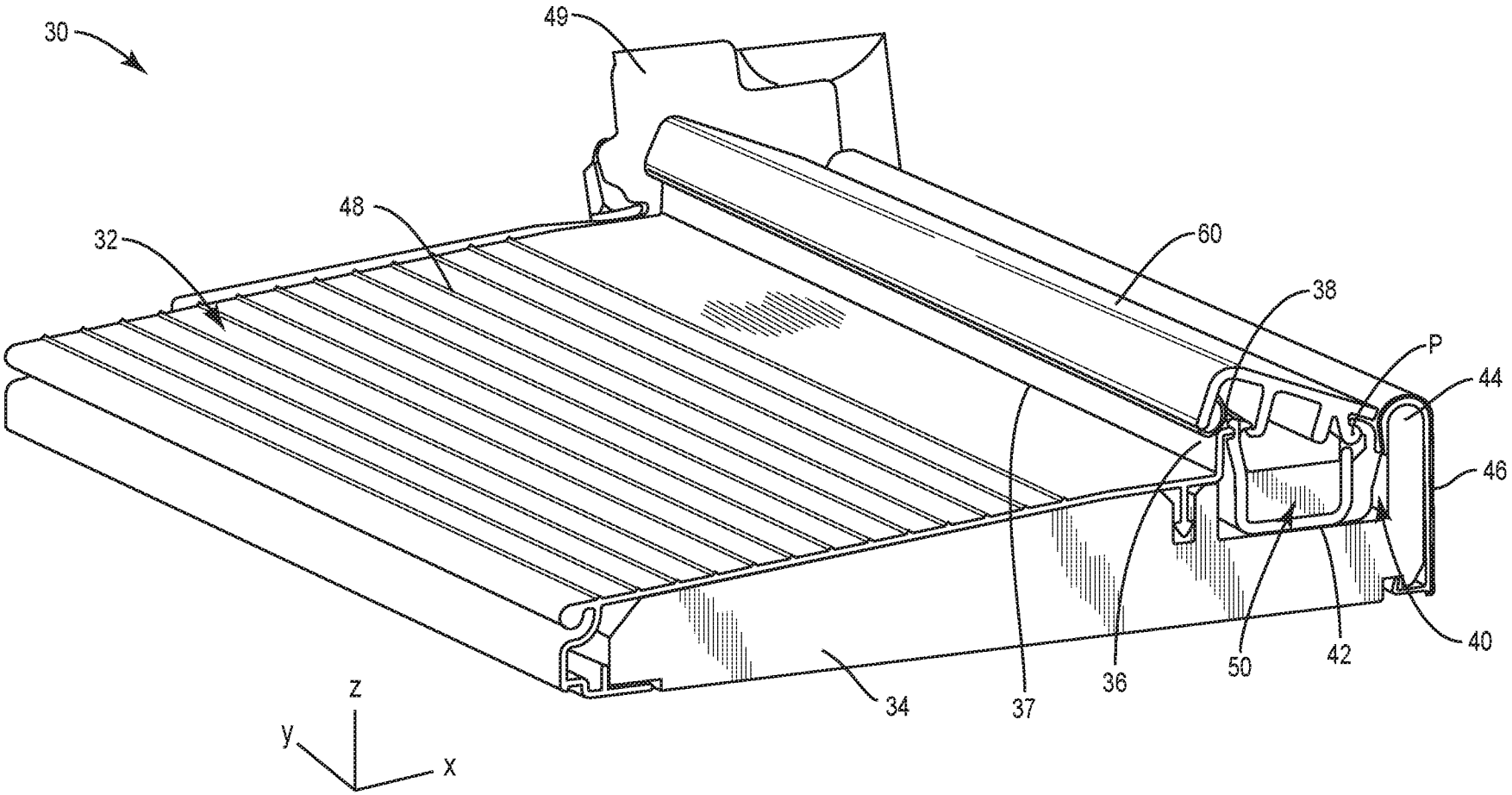
FIG. 2 is a perspective view of a threshold according to an embodiment of the present disclosure.

FIG. 2 shows a portion of an assembled threshold 30 according to an embodiment of the present disclosure from an exterior perspective view. As shown, the threshold 30 may include a sill deck 32 disposed upon a substrate 34. A dam 36 may extend upwardly from an inward end 37 of the sill deck 32. In some embodiments, the dam 36 may be formed as part of the sill deck 32. In other embodiments, the dam 36 may be formed separate from the sill deck 32, such as integral with the substrate 34. The dam 36 may include a lip 38 at the top thereof. The lip 38 may extend substantially horizontally in an inward direction toward an interior of a building when the threshold 30 is in use. Interior of the dam 36, a sill channel 40 may be formed. The sill channel 40 can be described as upwardly open. The sill channel 40 may have an exterior wall formed at least partially by the dam 36. The sill channel 40 can have a lower surface provided by a floor 42, which may be at least partially defined by the substrate 34. An interior wall, which can be formed at least partially by a nosing 44, can provide the third wall of the sill channel 40. The nosing 44 may be formed as an integral part of the substrate 34 as shown, or the nosing 44 may be separately attached to the substrate 34. In several embodiments, a decorative nosing cover 46 may be provided over and around the nosing 44. The sill deck 32 may provide a tread surface 48 along a portion outward of the dam 36. The threshold 30 may be sealed to the jambs 20 (FIG. 1) using gaskets 49. Example gaskets that may be suitable for use with the threshold of the present disclosure are described in U.S. Pat. No. 9,624,716 to Mitchell, the entire contents of which are hereby incorporated by reference.

The threshold 30 of FIG. 2 may also include one or more holders 50 positioned within the sill channel 40 to support and retain a threshold cap 60. In some embodiments, the holders 50 are substantially entirely within the sill channel 40. In some embodiments, not shown, the holder 50 may be integral with the substrate 34 or integral with the sill deck 32. In the illustrated embodiment, the holder 50 is removably disposed within the sill channel 40. Specifically, the holder 50 is releasably coupled within the sill channel 40 of the threshold 30. Configuring the holder 50 to be removable from the sill channel 40 may be advantageous for manufacturing and assembly purposes, such as creating interchangeability of component parts to provide multiple products with fewer unique components. In an embodiment, a plurality of holders 50 are used to support the threshold cap 60, the holders 50 being spaced apart along a length (y-axis) of the sill channel 40.

The holder 50 may be formed from plastic, such as polypropylene. The holder 50 may be formed from processes such as injection molding, extrusion, or additive manufacturing.

Figure 3:
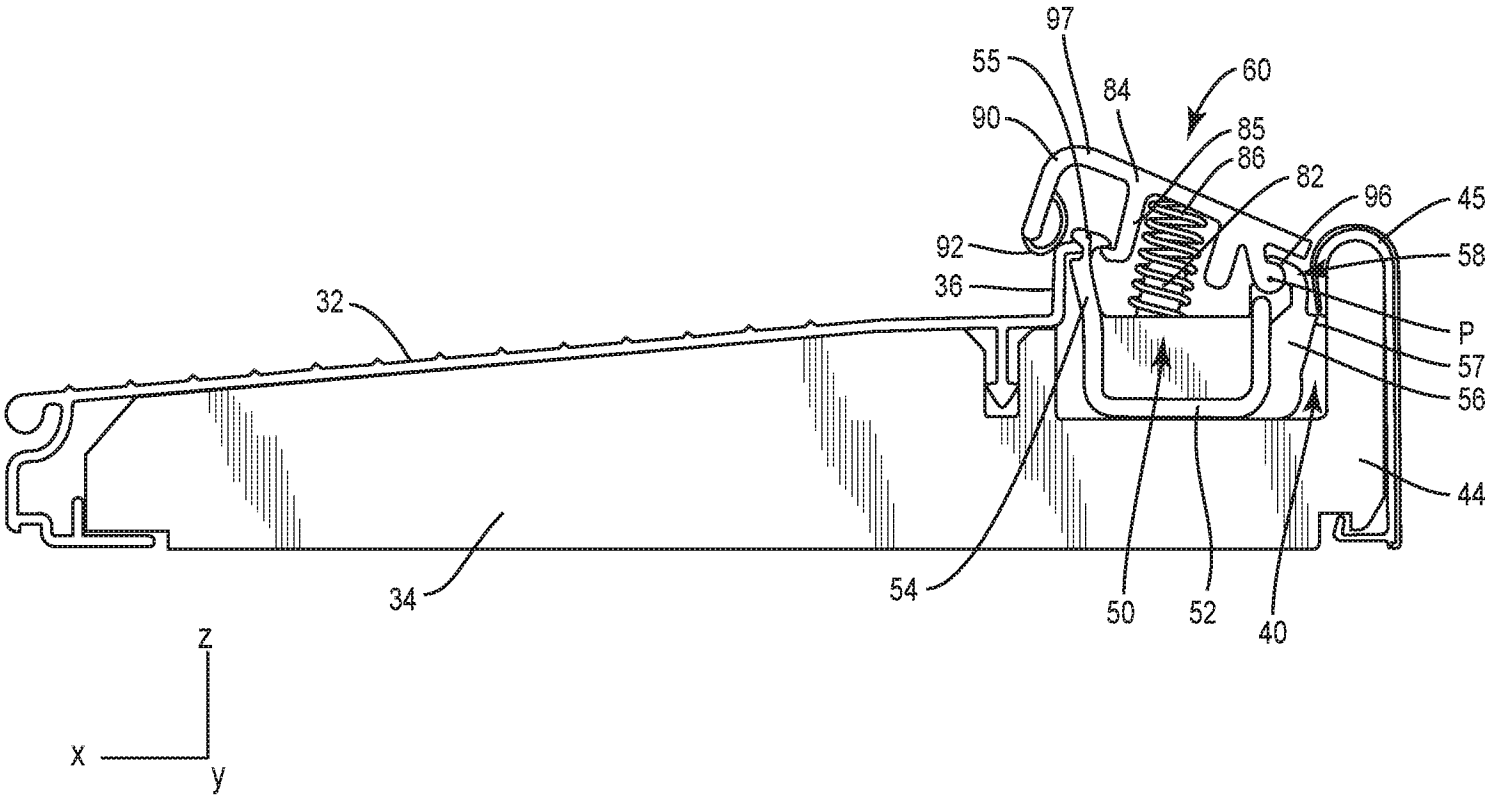
FIG. 3 is an end view of the threshold of FIG. 2 in a raised, door-open position.

As shown in FIG. 3, one function of the holders 50 is to support the threshold cap 60 with respect to the sill channel 40. Consistent with this function, the holders 50 may be configured to retain the threshold cap 60 and control a range of pivotal motion of the threshold cap about a pivot axis P. The holder 50 includes a base 52 supported along a floor 42 of the substrate 34 defining the channel 40. The holder 50 also including a projection 56 that extends away from the base 52 in a direction away from the floor 42, e.g., upward. The projection 56 is configured to support the threshold cap 60 about the pivot axis P. Specifically, the projection 56 defines a socket 58 that receives a portion of the threshold cap 60. The socket 58 defines the pivot axis P that passes through a center of the socket 58. The projection 56 may include a foot 57 that extends in a direction parallel with the base 52 and engages a portion of the threshold 30 to secure the holder 50 within the channel 40. Specifically, the foot 57 may engage a nosing cover 45 to secure the holder 50 within the channel 40. The holder 50 may also include a retainer 54 that extends away from the base 52 in a direction away from the floor 42, e.g., upward. The retainer 54 may engage a portion of the threshold 30 to secure the holder 50 within the retainer 54 may include a hook 55 that is configured to limit movement of the threshold cap 60 away from the floor 42 as detailed below.

The holder 50 may also include a post 82. The post 82 may be configured to extend along a substantially vertical direction (the z-axis) or may be provided at a pre-determined angle relative to vertical. For example, the post 82 may be configured to be substantially normal to a top, sealing wall 84 of the threshold cap 60 in at least one position of the threshold cap. The post 82 may be configured to support a coil spring 86 between the holder 50 and the threshold cap 60. The spring 86 may be included to provide a force intending to bias the threshold cap 60 toward a raised position thereof, both when a corresponding door panel is open and when the corresponding door panel is closed. The present disclosure is not limited to biasing the threshold cap 60 with a coil spring 86, but may alternatively include other resilient members formed from resilient materials capable of providing a spring force, such as a leaf spring 686 (FIG. 6), or elastic memory materials such as rubber, foam, or Hytrel® that are capable of acting to provide a force which acts to move the threshold cap toward the raised position when the elastic material is deformed. The spring 86 or other resilient member used for biasing the threshold cap 60 may be relatively separate from the threshold cap 60 and the base 50 as shown in the presently illustrated embodiment. Alternatively, the resilient member may be integrated with the holder 50 or integrated with the threshold cap 60.

The threshold cap 60 includes a sealing wall 84 configured to provide a sealing surface when a door panel is in the closed position. A second wall 90 may extend from an exterior end 97 of the sealing wall 84. The second wall 90 may be configured to be positioned along an exterior side of the dam 36. A seal 92 may be attached to the second wall 90. The seal 92 is configured to limit intrusion of water between the second wall 90 and the dam 36. The seal 92 may be a resilient bulb. The seal 92 may be co-extruded with the remainder of the threshold cap 60. Alternatively, the seal 92 may be joined to the second wall 90 by other attachments. In other embodiments, the seal 92 may be attached to the dam 36 instead of being movable with the second wall 90.

The threshold cap 60 further comprises a joint portion 96. The joint portion 96 is configured to mate with the holder 50 to facilitating pivoting of the threshold cap about the pivot axis P. In the illustrated embodiment, the joint portion 96 includes a connection arm, where the distal end of the connection arm may be formed with a tip having substantially circular profile. The tip is configured for insertion into the socket 58 defined by the holder 50, wherein the tip may be able to function as a pin of a hinge as the threshold cap 60 is able to pivot relative to the holder 50.

The threshold cap 60 may include a leg 85 that extends from the sealing wall 84 along an interior side of the dam 36. The leg 85 is configured to interact with the hook 55 of the retainer 54 of the base 50 to limit pivoting of the threshold cap 60 towards the raised position. In some embodiments, a portion of the sealing wall 84 may engage the projection 56 of the base 50 to limit pivoting of the threshold cap 60 towards the raised position.

The threshold cap 60 may be integrally formed, for example by a polymer or metal extrusion process that creates the threshold cap 60 with a substantially constant profile along the length thereof. The threshold cap 60 may be formed from a material, such as PVC or aluminum, to produce a substantially rigid body. Thus, the threshold cap 60 may be configured to rotate about the pivot axis P without significant bending or flexing of the threshold cap 60 itself.

FIG. 3 shows the threshold 30 with the threshold cap 60 in an upwardmost position. As shown, the threshold cap 60 may be constantly biased toward the upwardmost position by the spring 86 or other resilient member in the illustrated embodiment. The threshold cap 60 may assume the upwardmost position when a corresponding door panel (e.g., door 8 in FIG. 1) is in the opening position.

As described above, the second wall 90 is configured to be positioned along an exterior side of the dam 36. The pivot axis P of the threshold cap 60 is positioned substantially adjacent to the nosing 44. As a result, the exterior end of the sealing wall 84 may define the portion of the threshold cap 60 farthest from the pivot axis P, and therefore the portion may adjust by the greatest magnitude along a vertical direction between the raised and lowered positions. In some embodiments, the base 50 may be received within the channel 40 with the projection 56 adjacent the dam 36 such that the pivot axis P is adjacent the dam 36. In such embodiments, the interior end of the sealing wall 84 may define a portion of the threshold cap farthest form the pivot axis, and therefore the portion may adjust by the greatest magnitude along a vertical direction between the raised and lowered positions.

Figure 4:
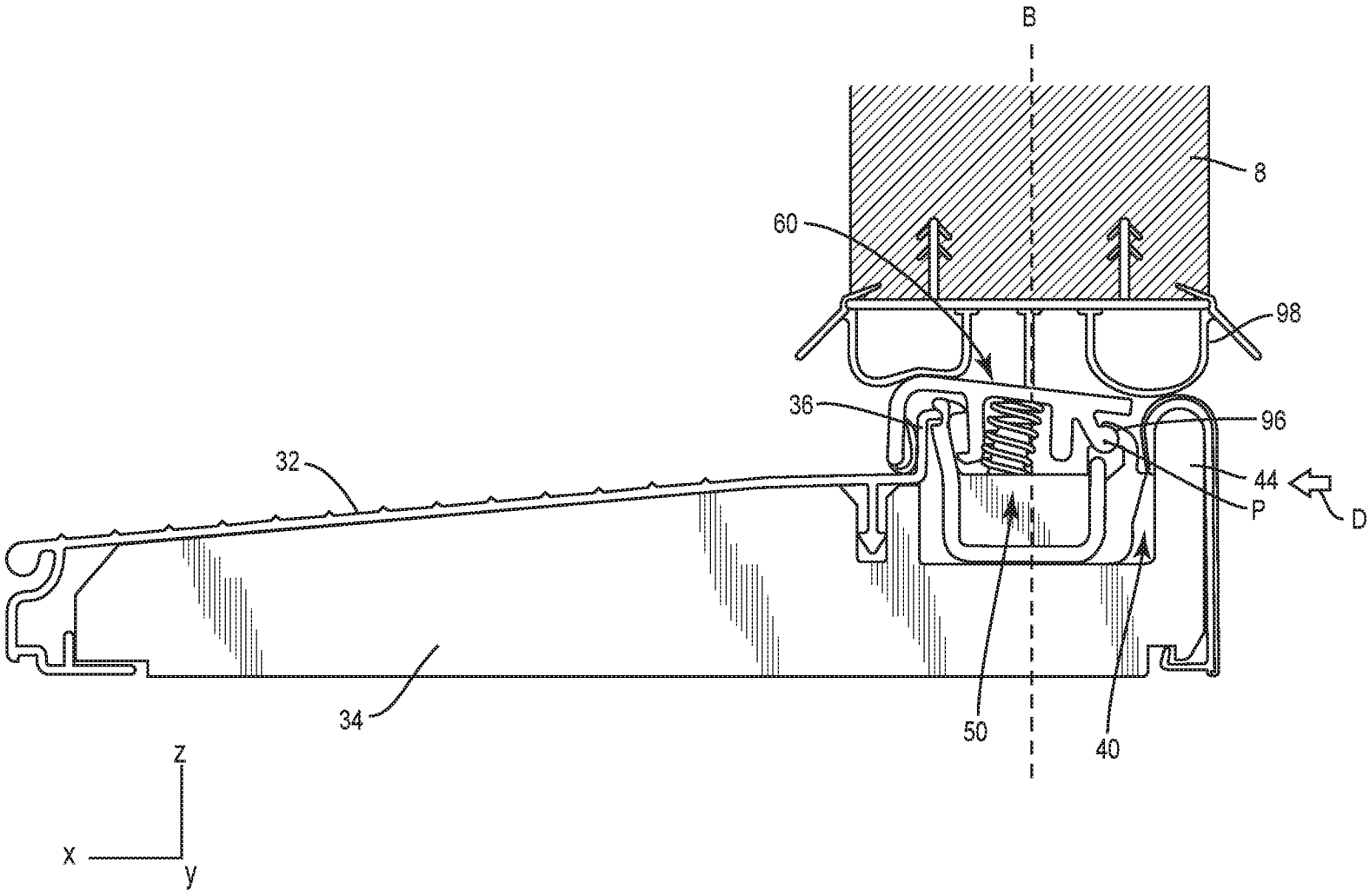
FIG. 4 is an end view of the threshold of FIG. 2 in a lowered, door-closed position.

FIG. 4 shows a door panel 8 in a closed position. A bottom surface of the door panel 8 may carry a door sweep 98 for forming a seal with the sealing surface 84 of the threshold cap 60. One suitable door sweep 98 may include an interior bulb, an exterior bulb, and an intermediate fin, each formed of a resilient material and configured to form a seal with the top surface of the rigid sealing wall 84 of the threshold cap 60. While pliable, the resilient portions of the door sweep 98 are configured to provide sufficient force on the sealing wall 84 of the threshold cap 60 to oppose the biasing force provided by the spring 86 and cause the threshold cap to pivotably deflect downward away from the upwardmost position shown in FIG. 3 to a lowered position as shown in FIG. 4.

Again, the threshold 30 of the illustrated example may be preferably used with an in-swing door. Therefore, to close the door panel 8 to the position shown in FIG. 4, the door panel travels in the direction of arrow D in FIG. 4. The pivot axis P is arranged closer to the nosing 44 than the dam 36 and therefore also on an interior side of a bisector B normal to the bottom of the door panel 8.

Figure 5:
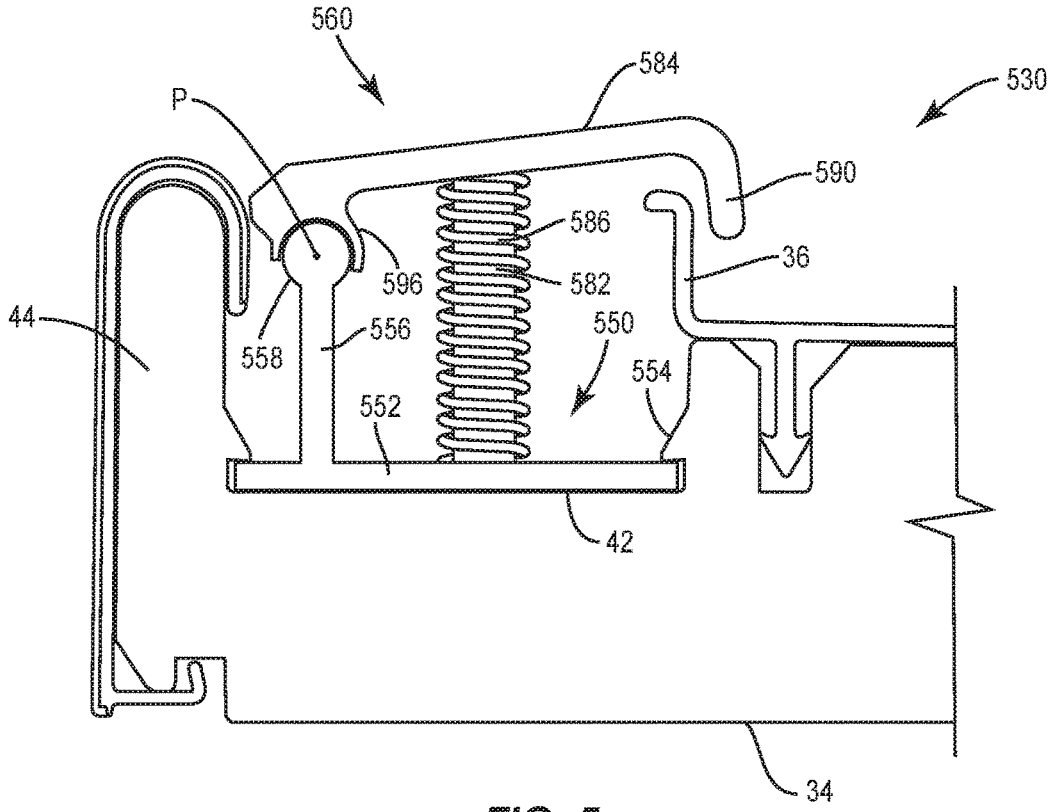
FIG. 5 is a partial end view of a threshold according to a second embodiment of the present disclosure.

FIG. 5 shows a profile of a second embodiment of a threshold 530. The present embodiment of the threshold 530 includes at least one holder 550 and a threshold cap 560. The holder 550 includes a base 552 in the form of a plate resting on the floor 42 of the substrate 34. The base 552 may be retained by sets of fingers 554 that may be integral with the substrate 34. The holder 550 may include a projection 556 having a rounded, bulb-shaped tip 558 to define the pivot axis P for the threshold cap 560. The projection 556 may extend substantially vertically upward from the base 552. In the illustrated embodiment, a post 582 extends from the base 552 to retain a spring 586, such as a coil spring, configured to bias the threshold cap 560 upward. As shown, the pivot axis P is closer to the nosing 44 than to the dam 36.

Similar to the threshold cap 60 (FIG. 2) of the first embodiment, the threshold cap 560 of the embodiment of FIG. 5 includes a sealing wall 584, a second wall 590, and a joint portion 596. The joint portion 596 may be a socket that is configured to slide onto or snap onto the bulb-shaped tip 558 such that the threshold cap 560 can pivot around the pivot axis P. The joint portion 596 may have a continuous profile or may be created by pairs of fingers that are spaced apart along the length of the threshold cap 560. A seal between the threshold cap and the dam is not shown, but may be present as discussed above with respect to the first embodiment.

Figure 6:
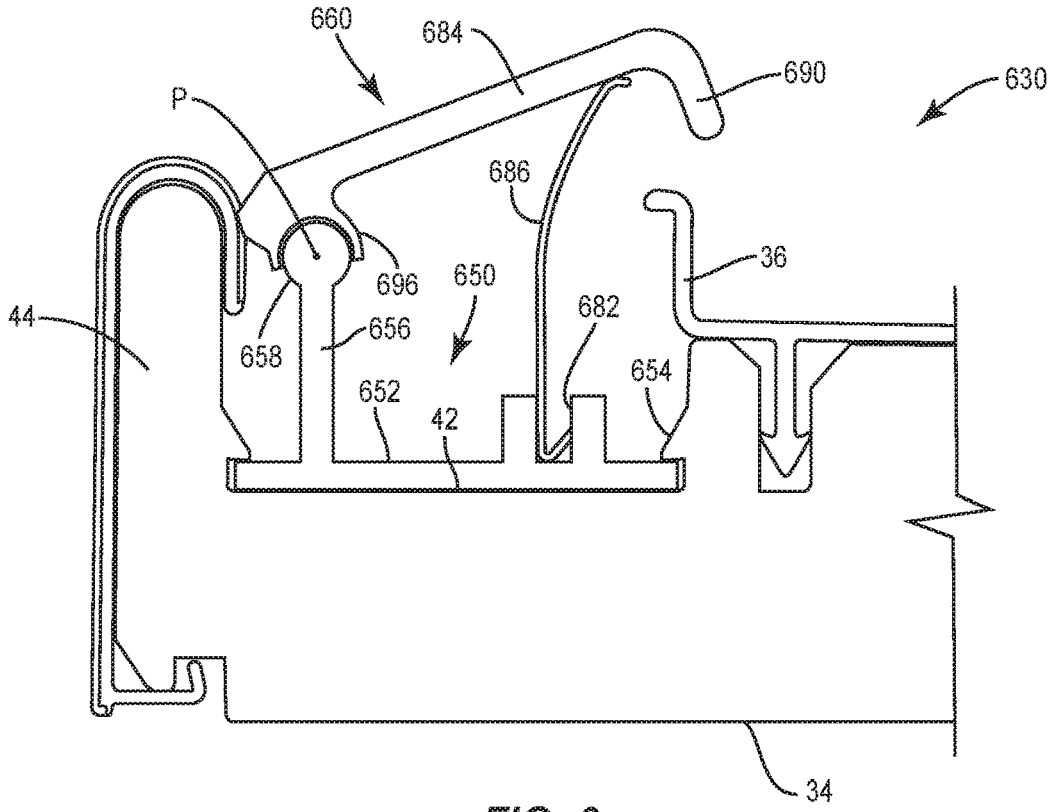
FIG. 6 is a partial end view of a threshold according to a third embodiment of the present disclosure.

FIG. 6 shows a profile of a third embodiment of a threshold 630. The present embodiment of the threshold 630 includes at least one holder 650 and a threshold cap 660. The holder 650 includes a base 652 in the form of a plate resting on the floor 42 of the substrate 34. The base 652 may be retained by sets of fingers 654 that may be integral with the substrate 34. The holder 650 may include a projection 656 having a rounded, bulb-shaped tip 658 to define the pivot axis P for the threshold cap 660. In the illustrated embodiment, a kerf 682 retains the end of a spring 686, particularly a leaf spring, used to bias the threshold cap 660 upward (counterclockwise from the illustrated view).

Similar to the threshold cap 60 of the first embodiment, the threshold cap 660 of the embodiment of FIG. 6 includes a sealing wall 684, a second wall 690, and a joint portion 696. The joint portion 696 may be configured to slide onto or snap onto the bulb-shaped tip 658 such that the threshold cap 660 can pivot around the pivot axis P. A seal between the threshold cap and the dam is not shown, but may be present as discussed above with respect to the first embodiment. The threshold caps 560 and 660 shown in FIGS. 5 and 6 may be substantially similar.

Figure 7:
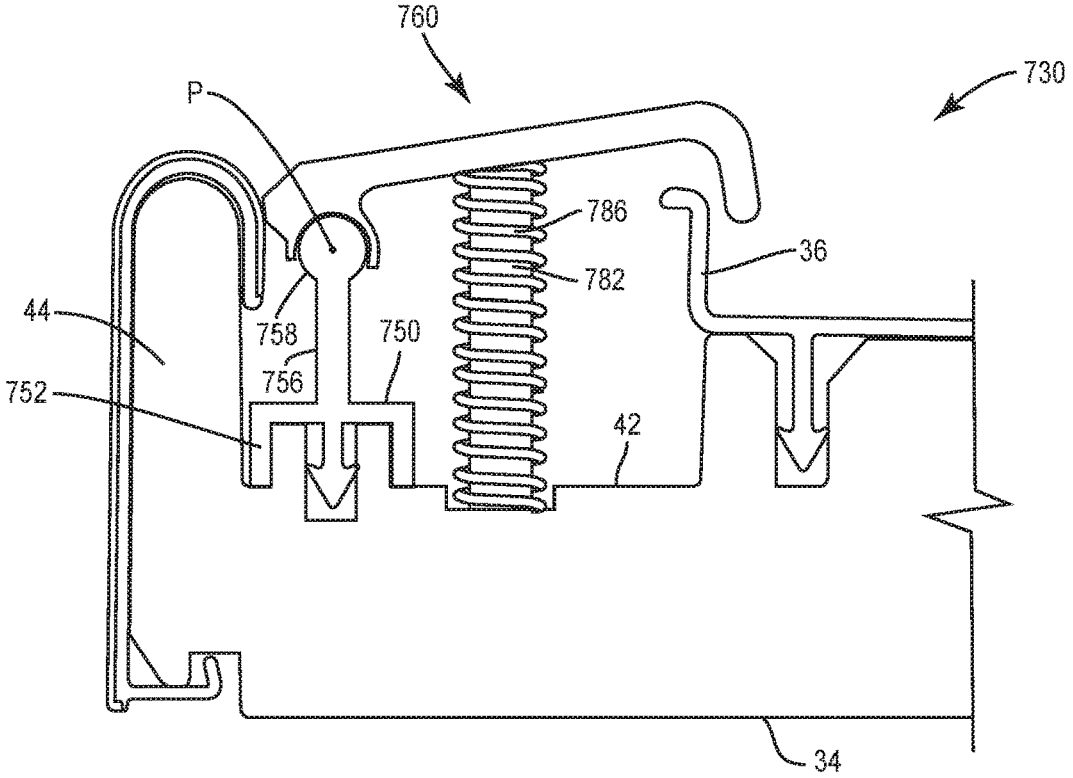
FIG. 7 is a partial end view of a threshold according to a fourth embodiment of the present disclosure.

FIG. 7 shows a profile of a fourth embodiment of a threshold 730. The present embodiment of the threshold 730 includes at least one holder 750 and a threshold cap 760. The holder 750 includes a base 752 in the form of a connector configured to plug into a kerf on the floor 42 of the substrate 34. The holder 750 may include a projection 756 having a rounded, bulb-shaped tip 758 to define the pivot axis P for the threshold cap 760. In the illustrated embodiment, a post 782 retains the end of a spring 786, the post being integral with the substrate. The threshold cap 760 of FIG. 7 may be substantially similar to the threshold caps 560 and 660 of FIGS. 5 and 6 respectively.

Figure 8:
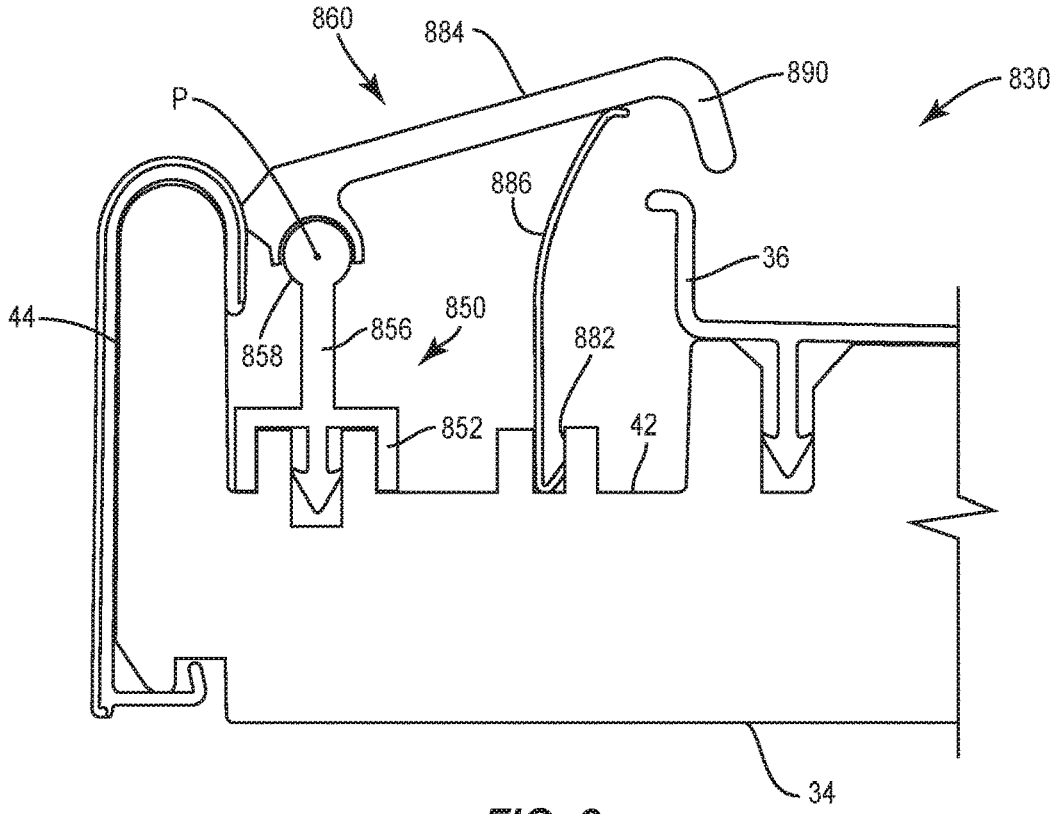
FIG. 8 is a partial end view of a threshold according to a fifth embodiment of the present disclosure.

FIG. 8 shows a profile of a fifth embodiment of a threshold 830. The present embodiment of the threshold 830 includes at least one holder 850 and a threshold cap 860. The holder 850 includes a base 852 in the form of a connector configured to plug into a kerf on the floor 42 of the substrate 34. The holder 850 may include a projection 856 having a rounded, bulb-shaped tip 858 to define the pivot axis P for the threshold cap 860. In the illustrated embodiment, a kerf 882 retains the end of a spring 886, such as a leaf spring, the kerf being integral with the substrate. The threshold cap 860 of FIG. 8 may be substantially similar to the threshold caps 560, 660, 760 of FIGS. 5-7 respectively. Specifically, the threshold cap 860 includes a sealing wall 884 and a second wall 890 similar to the sealing walls and second walls detailed with respect to the threshold caps 560, 660, 760.

Figure 9:
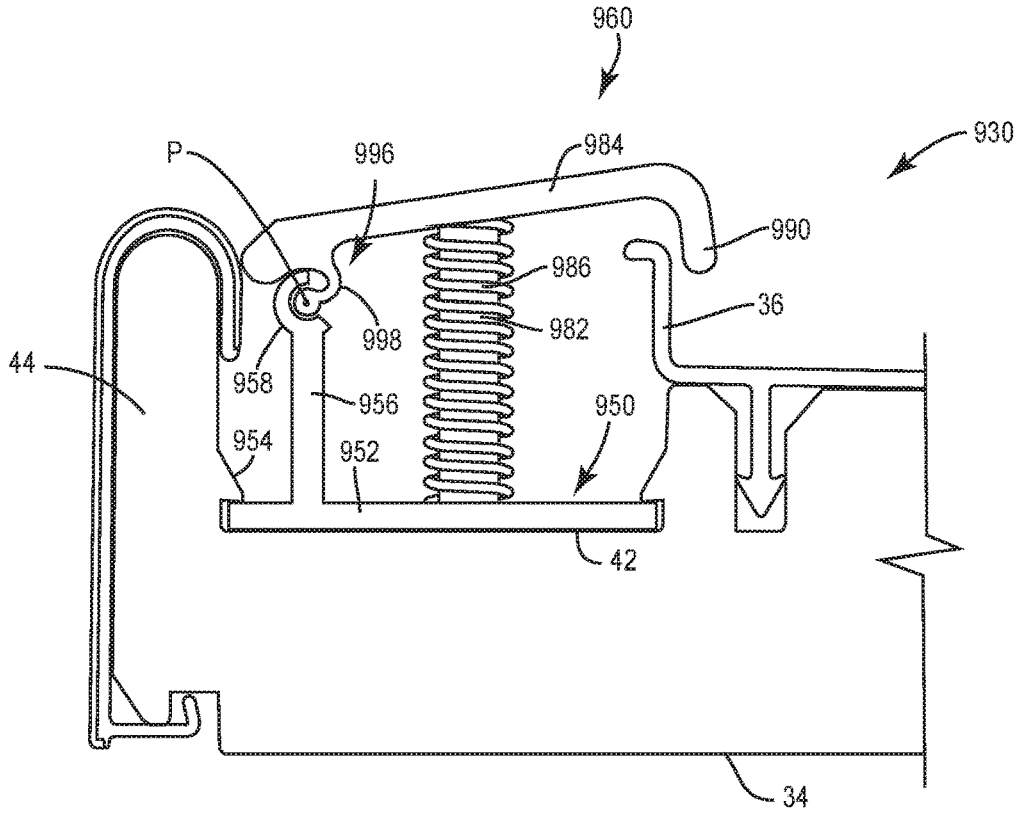
FIG. 9 is a partial end view of a threshold according to a sixth embodiment of the present disclosure.

FIG. 9 shows a profile of a sixth embodiment of a threshold 930. The present embodiment of the threshold 930 includes at least one holder 950 and a threshold cap 960. The holder 950 includes a base 952 in the form of a plate resting on the floor 42 of the substrate 34. The base 952 may be retained by sets of fingers 954 that may be integral with the substrate 34. The holder 950 may include a projection 956 having a socket 958 formed at the distal end thereof. The socket 958 may include a barrel-shaped cavity and a rounded exterior contour. The barrel-shaped cavity has a longitudinal axis defining the pivot axis P for the threshold cap 960. In the illustrated embodiment, a post 982 retains the end of a spring 986, such as a coil spring, for biasing the threshold cap toward an upward position.

Similar to the threshold cap 60 of the first embodiment, the threshold cap 960 of the embodiment of FIG. 9 includes a sealing wall 984, a second wall 990, and a joint portion 996. The joint portion 996 may include a protrusion 998 whose end is configured to slide into or snap into the barrel-shaped interior of the socket 958 such that the threshold cap 960 can pivot around the pivot axis P. A seal between the threshold cap and the dam is not shown, but may be present as discussed above with respect to the first embodiment.

Figure 10:
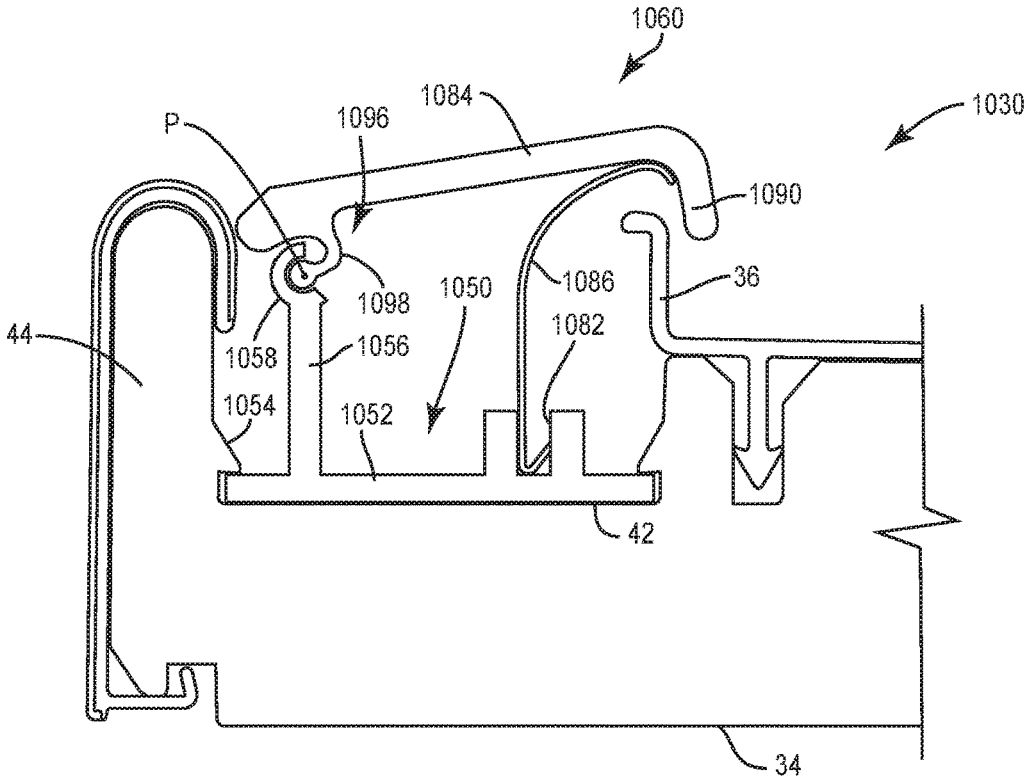
FIG. 10 is a partial end view of a threshold according to a seventh embodiment of the present disclosure.

FIG. 10 shows a profile of a seventh embodiment of a threshold 1030. The present embodiment of the threshold 1030 includes at least one holder 1050 and a threshold cap 1060. The holder 1050 includes a base 1052 in the form of a plate resting on the floor 42 of the substrate 34. The base 1052 may be retained by sets of fingers 1054 that may be integral with the substrate 34. The holder 1050 may include a projection 1056 having a socket 1058 formed at the distal end thereof. The socket 1058 may include a barrel-shaped cavity and a rounded exterior contour. The barrel-shaped cavity has a longitudinal axis defining the pivot axis P for the threshold cap 1060. In the illustrated embodiment, a kerf 1082 retains the end of a spring 1086, such as a leaf spring.

Similar to the threshold cap 60 of the first embodiment, the threshold cap 1060 of the embodiment of FIG. 10 includes a sealing wall 1084, a second wall 1090, and a joint portion 1096. The joint portion 1096 may include a protrusion 1098 whose end is configured to slide into or snap into the barrel-shaped interior of the socket 1058 such that the threshold cap 1060 can pivot around the pivot axis P. A seal between the threshold cap and the dam is not shown, but may be present as discussed above with respect to the first embodiment.

Figure 11:
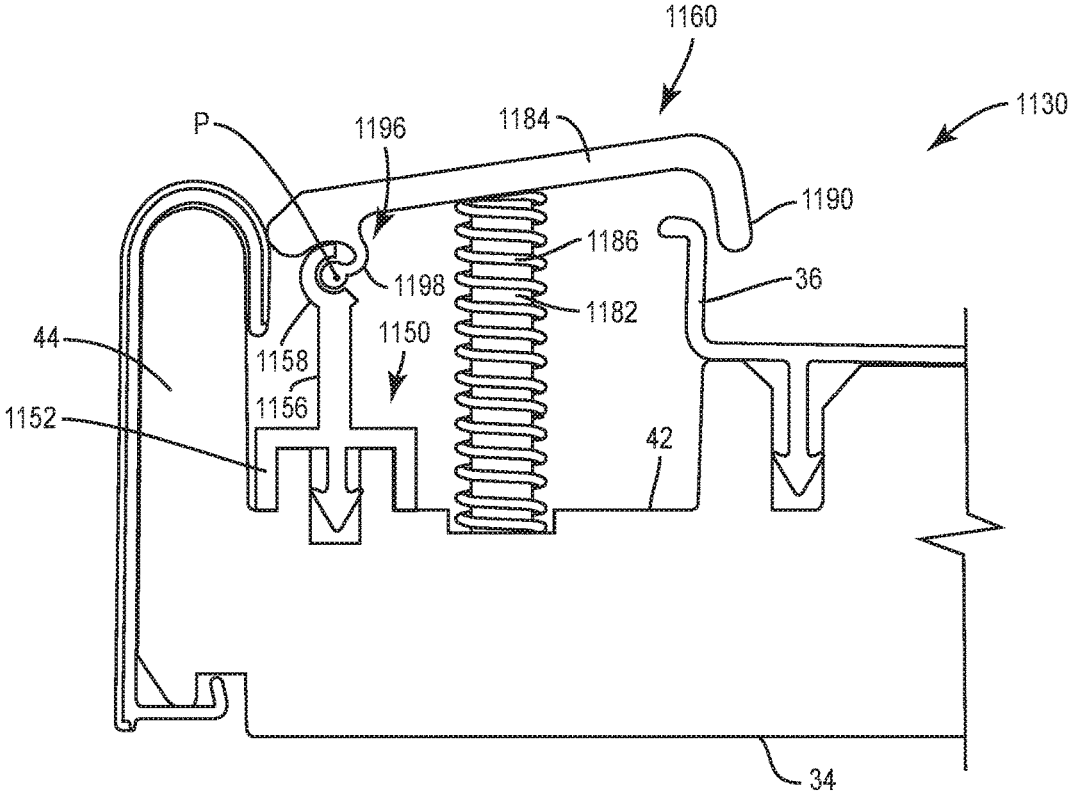
FIG. 11 is a partial end view of a threshold according to an eighth embodiment of the present disclosure.

FIG. 11 shows a profile of an eighth embodiment of a threshold 1130. The present embodiment of the threshold 1130 includes at least one holder 1150 and a threshold cap 1160. The holder 1150 includes a base 1152 in the form of a connector for plugging into a kerf on the floor 42 of the substrate 34. The holder 1150 may include a projection 1156 having a socket 1158 formed at the distal end thereof. The socket 1158 may include a barrel-shaped cavity and a rounded exterior contour. The barrel-shaped cavity has a longitudinal axis defining the pivot axis P for the threshold cap 1160. In the illustrated embodiment, a post 1182, integral with the substrate 34, retains the end of a spring 1186, such as a coil spring.

Similar to the threshold cap 60 of the first embodiment, the threshold cap 1160 of the embodiment of FIG. 11 includes a sealing wall 1184, a second wall 1190, and a joint portion 1196. The joint portion 1196 may include a protrusion 1198 whose end is configured to slide into or snap into the barrel-shaped interior of the socket 1158 such that the threshold cap 1160 can pivot around the pivot axis P. A seal between the threshold cap and the dam is not shown, but may be present as discussed above with respect to the first embodiment.

Figure 12:
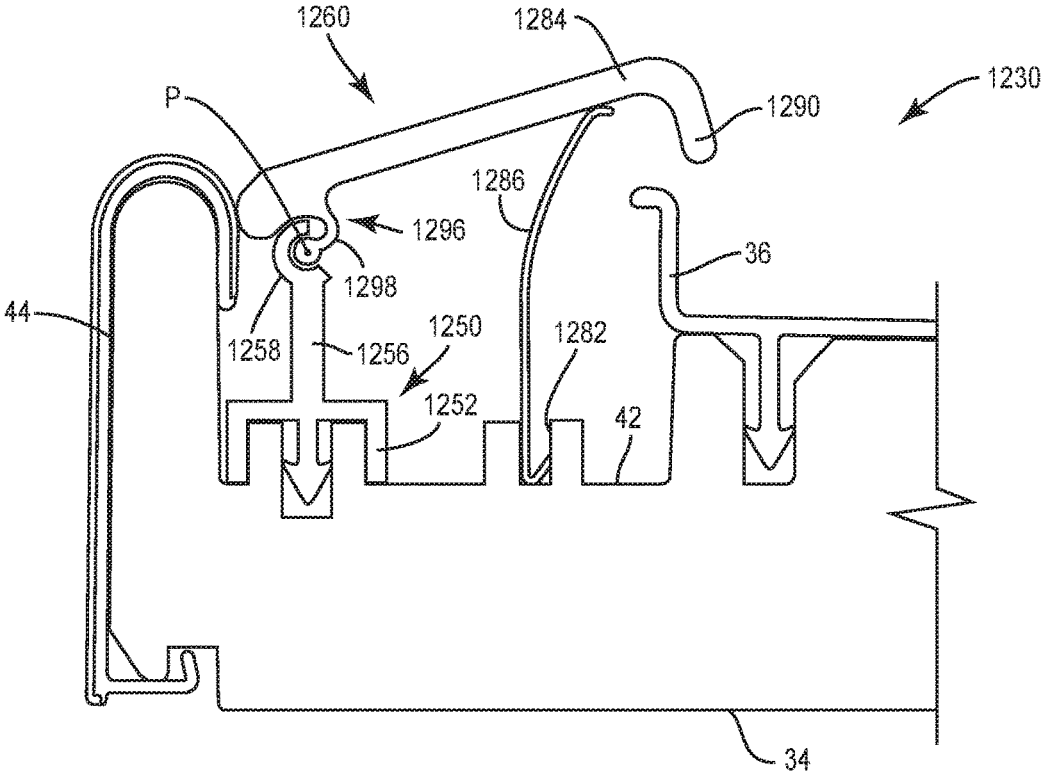
FIG. 12 is a partial end view of a threshold according to a ninth embodiment of the present disclosure.

FIG. 12 shows a profile of a ninth embodiment of a threshold 1230. The present embodiment of the threshold 1230 includes at least one holder 1250 and a threshold cap 1260. The holder 1250 includes a base 1252 in the form of a connector for plugging into a kerf on the floor 42 of the substrate 34. The holder 1250 may include a projection 1256 having a socket 1258 formed at the distal end thereof. The socket 1258 may include a barrel-shaped cavity and a rounded exterior contour. The barrel-shaped cavity has a longitudinal axis defining the pivot axis P for the threshold cap 1260. In the illustrated embodiment, a kerf 1282 retains the end of a spring 1286, such as a leaf spring.

Similar to the threshold cap 60 of the first embodiment, the threshold cap 1260 of the embodiment of FIG. 12 includes a sealing wall 1284, a second wall 1290, and a joint portion 1296. The joint portion 1296 may include a protrusion 1298 whose end is configured to slide into or snap into the barrel-shaped interior of the socket 1258 such that the threshold cap 1260 can pivot around the pivot axis P. A seal between the threshold cap and the dam is not shown, but may be present as discussed above with respect to the first embodiment.

Figure 13:
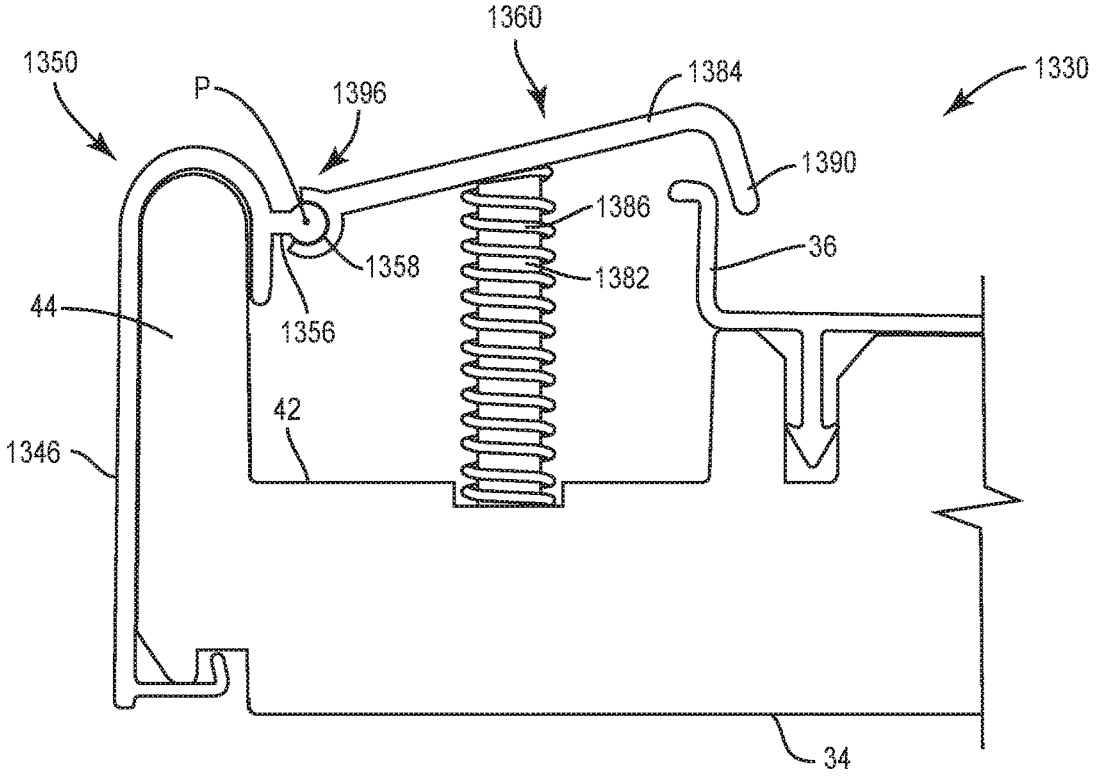
FIG. 13 is a partial end view of a threshold according to a tenth embodiment of the present disclosure.

FIG. 13 shows a profile of a tenth embodiment of a threshold 1330. The present embodiment of the threshold 1330 includes at least one holder 1350 and a threshold cap 1360. The holder 1350 is provided in the form of a nosing cover 1346 that attaches to the nosing 44. The holder 1350 may include a projection 1356 extending in a substantially horizontal direction from a position near the top of the nosing 44. Alternatively, the projection 1356 may be integral with the nosing 44 instead of a removable nosing cover 1346. A distal end of the projection may form a bulb-shaped tip 1358 defining the pivot axis P for the threshold cap 1360. In the illustrated embodiment, a post 1382 that is formed as part of the substrate retains the end of a spring 1386, such as a coil spring.

Similar to the threshold cap 60 of the first embodiment, the threshold cap 1360 of the embodiment of FIG. 13 includes a sealing wall 1384, a second wall 1390, and a joint portion 1396. The joint portion 1396 may be configured to create a socket for sliding onto or snapping onto the bulb-shaped tip 1358 such that the threshold cap 1360 can pivot around the pivot axis P. Whereas in several embodiments, the joint portion is provided along an underside of the sealing wall, the joint portion 1396 of the threshold cap 1360 is provided at a distal interior end of the sealing wall 1384, opposite the second wall 1390. A seal between the threshold cap and the dam is not shown, but may be present as discussed above with respect to the first embodiment.

Figure 14:
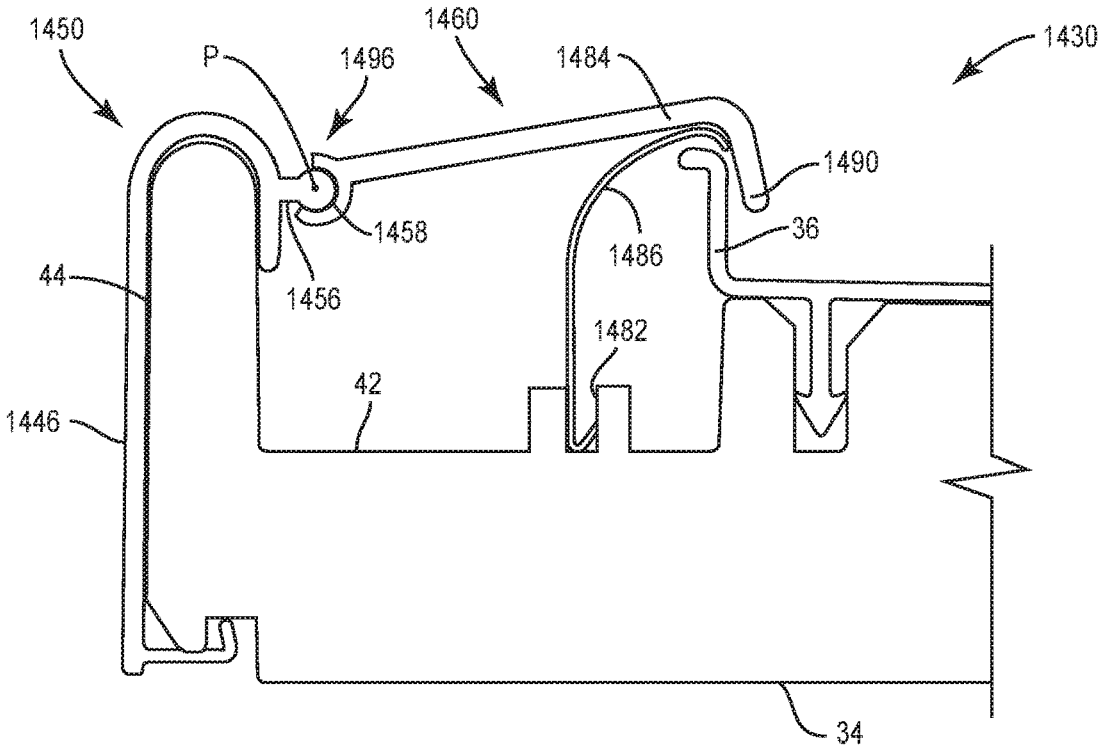
FIG. 14 is a partial end view of a threshold according to an eleventh embodiment of the present disclosure.

FIG. 14 shows a profile of an eleventh embodiment of a threshold 1430. The present embodiment of the threshold 1430 includes at least one holder 1450 and a threshold cap 1460. The holder 1450 is provided in the form of a nosing cover 1446 that attaches to the nosing 44. The holder 1450 may include a projection 1456 extending in a substantially horizontal direction from a position near the top of the nosing 44. Alternatively, the projection 1456 may be integral with the nosing 44 instead of a removable nosing cover 1446. A distal end of the projection may form a bulb-shaped tip 1458 defining the pivot axis P for the threshold cap 1460. In the illustrated embodiment, a kerf 1482 that is formed as part of the substrate retains the end of a spring 1486, such as a leaf spring.

Similar to the threshold cap 60 of the first embodiment, the threshold cap 1460 of the embodiment of FIG. 14 includes a sealing wall 1484, a second wall 1490, and a joint portion 1496. The joint portion 1496 may be configured to create a socket for sliding onto or snapping onto the bulb-shaped tip 1458 such that the threshold cap 1460 can pivot around the pivot axis P. Whereas in several embodiments, the joint portion is provided along an underside of the sealing wall, the joint portion 1496 of the threshold cap 1460 is provided at a distal interior end of the sealing wall 1484, opposite the second wall 1490. A seal between the threshold cap and the dam is not shown, but may be present as discussed above with respect to the first embodiment.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed:

1. An assembly configured to form a seal with a bottom of a closed door panel, the assembly comprising:

a sill deck having a first end forming an upstanding dam and extending from the first end to a second end configured to be disposed on an exterior side of the closed door panel, the dam defining a portion of an exterior side of a channel;

a holder including a socket, the socket defining a pivot axis passing through a center of the socket, the holder selectively secured within the channel such that the pivot axis is within the channel, the holder formed separate from the sill deck;

a threshold cap including a sealing wall and a joint portion, the sealing wall configured to form a seal with the bottom of the closed door, the joint portion engaged with the holder to pivotally support the threshold cap about the pivot axis; and a biasing member biasing the sealing wall away from the holder towards a raised position.

2. The assembly according to claim 1, wherein the holder includes a base and a projection extending away from the base, the projection defining a socket about the pivot axis, the joint portion received within the socket.

3. The assembly according to claim 1, wherein the holder includes a base and a projection extending away from the base, the projection including a bulb-shaped tip about the pivot axis, the joint portion defining a socket that receives the tip.

4. The assembly according to claim 3, wherein the socket is configured to snap onto the tip of the holder.

5. The assembly according to claim 3, wherein the socket is configured to slide onto the tip of the holder.

6. The assembly according to claim 1, wherein one end of the biasing member is supported by the holder.

7. The assembly according to claim 6, wherein the holder includes a post extending towards the threshold cap, the one end of the biasing member disposed about the post.

8. The assembly according to claim 6, wherein the holder defines a kerf, the one end of the biasing member received within the kerf.

9. The assembly according to claim 1, wherein the biasing member is a coil spring.

10. The assembly according to claim 1, wherein the biasing member is a leaf spring.

11. The assembly according to claim 1, wherein the sealing wall has an interior end and an exterior end opposite the interior end, the exterior end configured to a move a greater magnitude as the threshold cap pivots about the pivot axis compared to a magnitude of movement of the interior end.

12. A threshold, comprising:

a substrate comprising:

a nosing facing an interior of the threshold;

a dam facing an exterior of the threshold and spaced apart from the nosing to define a channel therebetween; and an assembly comprising:

a sill deck having a first end forming an upstanding dam and extending from the first end to a second end in a direction away from the nosing;

a holder including a socket, the socket defining a pivot axis passing through a center of the socket, the holder selectively secured within the channel such that the pivot axis is within the channel, the holder formed separate from the sill deck;

a threshold cap including a sealing wall and a joint portion, the sealing wall configured to form a seal with a bottom of a closed door, the joint portion engaged with the holder to pivotally support the threshold cap about the pivot axis; and a biasing member biasing the sealing wall away from the holder towards a raised position.

13. The threshold according to claim 12, wherein the pivot axis is closer to the nosing than to the dam.

14. The threshold according to claim 12, wherein the holder is positioned entirely within the channel.

15. The threshold according to claim 12, further comprising a nosing cover disposed over the nosing and extending into the channel, the holder integrally formed with the nosing cover and extending within the channel from the nosing towards the dam.

16. The threshold according to claim 12, wherein the substrate defines a floor of the channel.

17. The threshold according to claim 16, wherein one end of the biasing member is supported by the floor of the channel.

18. The threshold according to claim 17, wherein the substrate includes a post extending from the floor towards the threshold cap, the one end of the biasing member disposed about the post.

19. The threshold according to claim 16, wherein the floor defines a kerf, the one end of the biasing member received within the kerf.

20. The threshold according to claim 16, wherein the holder includes a base and the floor defines a kerf, the base engaged with the kerf to releasably couple the holder within the channel.

21. The threshold according to claim 12, wherein the substrate includes a pair of fingers extending into the channel, the pair of fingers engaged with the holder to releasably couple the holder within the channel.

22. The threshold according to claim 12, wherein the threshold cap includes an interior end and an exterior end, the interior end configured to seal an interior side.

* * * * *